US006454936B1

(12) United States Patent
Varadaraj

(10) Patent No.: US 6,454,936 B1
(45) Date of Patent: Sep. 24, 2002

(54) REMOVAL OF ACIDS FROM OILS

(75) Inventor: Ramesh Varadaraj, Flemington, NJ (US)

(73) Assignee: ExxonMobil Research and Engineering Company, Annandale, NJ (US)

( * ) Notice: Subject to any disclaimer, the term of this patent is extended or adjusted under 35 U.S.C. 154(b) by 11 days.

(21) Appl. No.: 09/803,573

(22) Filed: Mar. 9, 2001

(51) Int. Cl.[7] ..... C10G 45/14; C10G 45/56
(52) U.S. Cl. ..... 208/263; 208/299; 208/307
(58) Field of Search ..... 208/263, 299, 208/307

(56) References Cited

U.S. PATENT DOCUMENTS

| | | | | |
|---|---|---|---|---|
| 2,424,158 A | | 7/1947 | Fuqua et al. | 196/41 |
| 3,761,534 A | * | 9/1973 | Sun et al. | 208/230 |
| 4,752,381 A | | 6/1988 | Ferguson et al. | 208/263 |
| 5,985,137 A | * | 11/1999 | Ohsol et al. | 208/263 |
| 6,096,196 A | | 8/2000 | Varadaraj et al. | 208/263 |

OTHER PUBLICATIONS

"Somochemical Treatment of Fossil Fuels"; Kazem M. Sadeghi, Jiunn–Ren Lin; Teh Fu Yen; Energy Sources, vol. 16, pp. 439–449, U.K., Department of Civil and Environmental Engineering, University of Southern California, Los Angeles, California.

An Upgrading Process Through Cavitation and Surfactant; Jiunn–Ren Lin and Teh Fu Yen; Enery & Fuels 1993, vol. 7, pp. 111–118; Department of Civil and Environmental Engineering, University of Southern California, Los Angeles, California; Received Jun. 1, 1992. Revised Manuscript Received Oct. 6, 1992.

"Ultrasound in Synthesis"; Kenneth S. Suslick; Modern Synthetic Methods 1986, vol. 4; School of Chemical Sciences University of Illinois at Urbana–Champaign, 505 S. Mathews Av., Urbana, Illinois 61801.

"Processing of Residual Oil Products by Visbraking in Presence of Additive in Form of Aromatised Fraction or Acetone, with Initial Cavitation Treatment of Starting Material"; M. B. Basin, Gimbutas, A. S and V. Yu Vainora; Mazheiksk Nafta Oil Refinery, (Abstract Only).

"Use of the Ultrasonic Cavitaion Effect of Reduce Oil Viscosity and Increase its Rate of Transport"; V. G. Andreev; O. S. Bryukhovetskii; O. I. Ponomareva and V. N. Rodionov; Pet. Abstr. 658,109; Izv. Vyssh. Ucheb. Zavedenii, Geol. Razvedka (4), (Jul.–Aug. 1996); Use of theP Petroleum Abstracts ABSTR. No. 658,109 V37, N.40, (Oct. 4, 1997), (Abstract Only).

"Cavitation Method for Processing Petroleum Refining Residues"; Akcine Bendrove 'Mazeikiu Nafta; Basin, Michail Borisovic; (Copyright 1997 by the American Chemical Society, CA 127:6987Q), (Abstract Only).

"The Effects of Ultrasonic Treatment on the Viscosity of Athabasca Bitumen and Bitumen–Solvent Mixtures", A Chakma and F. Berruti; the Journal of Canadian Petroleum Technology, May 1993 (vol. 32, No. 5); pp. 48–51.

"Ultrasonic Visbreaking of Athabasca Bitumen"; Amit Chakma and Franco Berruti; Petroleum Society of CIM and AOSTRA, Paper No. CIM/AOSTRA 91–9; Presented at the CIM/AOSTRA 1991 Technical Conference in Banff, Apr. 21–24, 1991; pp. 9–1 to 9–5.

"Ultrasonic Visbreaking of Athabasca Bitumen"; A. Chakma and F. Berruti, Department of Chemical and Petroleum Engineering, The University of Calgary, Calgary, Alberta, Canada T2N 1N4; pp. 101–104.

"Ultrasonic Visbreaking of Athabasca Bitumen"; A. Chakma and F. Berruti; Energy Processing/Canada; Sep.–Oct., 1991; pp. 16–19.

* cited by examiner

*Primary Examiner*—Walter D. Griffin
*Assistant Examiner*—Tam M. Nguyen
(74) *Attorney, Agent, or Firm*—Estelle C. Bakun

(57) ABSTRACT

The instant invention is directed to a process for decreasing the amount of acids contained in oils by forming a water-in-oil emulsion and utilizing solids.

21 Claims, No Drawings

REMOVAL OF ACIDS FROM OILS

FIELD OF THE INVENTION

The instant invention is directed to the removal of acids, especially organic acids such as naphthenic acids from oils including crude oils, crude oil blends and crude oil distillates using solids.

BACKGROUND OF THE INVENTION

High Total Acid Number (TAN) crudes are discounted by about $0.50/TAN/BBL. The downstream business driver to develop technologies for TAN reduction is the ability to refine low cost crudes. The upstream driver is to enhance the market value of high-TAN crudes.

The current approach to refine acidic crudes is to blend the acidic crudes with non acidic crudes so that the TAN of the blend is no higher than about 0.5. Most major oil companies use this approach. The drawback with this approach is that it limits the amount of acidic crude that can be processed. Additionally, it is known in the art to treat the crudes with inorganic bases such as potassium and sodium hydroxide to neutralize the acids. This approach, however, forms emulsions which are very difficult to break and, additionally, undesirably leaves potassium or sodium in the treated crude. Furthermore, such prior art techniques are limited by the molecular weight range of the acids they are capable of removing.

With the projected increase of acidic crudes in the market (Chad, Venezuela, North Sea) new technologies are needed to further refine higher TAN crudes and crude blends. Thermal treatment, slurry hydroprocessing and calcium neutralization are some of the promising approaches that have emerged. However, these technologies do not extract the acids from the crudes. Instead, they convert the acids to products that remain in the crude.

U.S. Pat. No. 4,752,381 is directed to a method for neutralizing the organic acidity in petroleum and petroleum fractions to produce a neutralization number of less than 1.0. The method involves treating the petroleum fraction with a monoethanolamine to form an amine salt followed by heating for a time and at a temperature sufficient to form an amide. Such amines will not afford the results desired in the instant invention since they convert the naphthenic acids, whereas the instant invention extracts and removes them.

U.S. Pat. No. 2,424,158 is directed to a method for removing organic acids from crude oils. The patent utilizes a contact agent which is an organic liquid. Suitable amines disclosed are mono-, di-, and triethanolamine, as well as methyl amine, ethylamine, n- and isopropyl amine, n-butyl amine, sec-butyl amine, ter-butyl amine, propanol amine, isopropanol amine, butanol amine, sec-butanol, sec-butanol amine, and ter-butanol amine. The cost of such amines for removal of naphthenic acids and the need to regenerate them, makes such a process uneconomical. Hence, a cost effective means for removal of naphthenic acids is needed.

SUMMARY OF THE INVENTION

The instant invention is directed to a process for extracting acids from a starting oil comprising the steps of:

(a) treating the starting oil containing acids with an amount of solids and water under conditions and for a time and at a temperature sufficient to form a water-in-oil emulsion of said starting oil, water and solids wherein said solids are selected from solids having a total average surface area of less than or equal to 1500 square microns;

(b) separating said emulsion of step (a) into a plurality of layers wherein one of such layers contains a treated oil having decreased amounts of organic acids;

(c) recovering said layer of step (b) containing said treated oil having a decreased amount of organic acid and layers containing water and solids.

DETAILED DESCRIPTION OF THE INVENTION

In the instant invention solids are added to starting oil (the oil from which acids are to be removed) along with water to form an emulsion which is then broken, separated into layers and the oil having decreased amounts of acid recovered. Beneficially, the process can be practiced using existing oil/water separation equipment with minor modifications.

The solids may be selected from solids having an average surface area of less than or equal to 1500 square microns, preferably from about 25 to about 1500 square microns, and most preferably about 50 to about 1500 square microns, and more preferably about 100 to about 1500 square microns. Suitably, the solids may be selected from silica, alumina, coke, montmorillonite clays such as bentonite, kaolinite, and mixtures thereof. Although other forms are likewise useable, when clays are selected, especially bentonite clay, the clay will preferably be in the gel form. In the gel form the clay sheets are divided or exfoliated. The procedure to prepare exfoliated or divided gel is know in the art. The main advantage of using the exfoliated clay is that the clay solids are in the form of sheets that are <than 10 nm thick and can be broken to 50 to 200 nm size plates. The solids utilized herein are hydrophilic, hydrophobic or amphiphilic. The solids are preferrably amphiphilic which means that they have a hydrophilic/hydrophobic character. One skilled in the art readily can identify such solids.

The invention is particularly applicable to crude oils, crude oil blends, and crude oil distillates and mixtures thereof. Some crude oils contain organic acids that generally fall into the category of naphthenic acids and other organic acids. Naphthenic acid is a generic term used to identify a mixture of organic acids present in a petroleum stock. Naphthenic acids may be present either alone or in combination with other organic acids, such as sulfonic acids and phenols. Thus, the instant invention is particularly suitable for extracting naphthenic acids.

In the instant invention, organic acids, including naphthenic acids which are removed from the starting oil or blends are preferably those having molecular weights ranging from about 150 to about 800, more preferably, from about 200 to about 750. The instant invention preferably substantially extracts or substantially decreases the amount of naphthenic acids present in the starting oil when the oil is a crude oil or combination thereof. By substantially is meant all of the acids except for trace amounts. However, it is not necessary for substantially all of the acids to be removed since the value of the treated crude is increased if even a portion of the naphthenic acids are removed. Applicants have found that the amount of naphthenic acids can be reduced by at least about 30%, preferably at least about 60% and, more preferably, at least about 86%.

Starting oils (including starting crudes) as used herein include any oil containing acids, and especially crude oils, crude blends, distillates and mixtures thereof. All that is necessary is that the starting oil contain acids, such as organic acids and preferably naphthenic acids. Preferably, if the starting oil is a crude oil, the starting crude will be a whole crude, but can also be acidic fractions (or distillates)

of a whole crude such as a vacuum gas oil. The starting oils are treated with an amount of solid capable of adsorbing the acids present in the starting oil. This typically will be from about 0.1 to about 5 wt % based on the amount of oil being treated and the amount of acids present. The instant invention is capable of removing naphthenic acids ranging in molecular weight from about 150 to about 800, preferably about 250 to about 750. The weight ranges for the naphthenic acids removed may vary upward or downward of the numbers herein presented, since the ranges are dependent upon the sensitivity level of the analytical means used to determine the molecular weights of the naphthenic acids removed.

The solids can be added alone or in combination with water. If added in combination, a solution of the solid and water may be prepared. About 5 to 30 wt % water is added based upon the amount of crude oil. Preferrably 5 to 10 wt %. Whether the solids are added in combination with the water or prior to the water, the crude is treated for a time and at a temperature at which a water-in-oil emulsion of water, oil, solids and organic acids will form. Contacting times depend upon the nature of the starting crude to be treated, its acid content, and the amount of solid added. The temperature of reaction is any temperature that will affect formation of the water-in-oil emulsion. Typically, the process is conducted at temperatures of about 20 to about 220° C., preferably, about 25 to about 130° C., more preferably, 25 to 80° C. The contact times will range from about 1 minute to 1 hour and, preferably, from about 3 to about 30 minutes. Pressures will range from atmospheric, preferably from about 60 psi (413.7 kPa) and, more preferably, from about 60 to about 1000 psi (413.7 kPa to about 6895 kPa). For heavier crudes, the higher temperatures and pressures are desirable. The crude is then mixed with water, if stepwise addition is performed at a temperature and for a time sufficient to form an emulsion. The times and temperatures remain the same for simultaneous addition and stepwise addition of the water. If the addition is done simultaneously, the mixing is conducted simultaneously with the addition at the temperatures and for the times described above. It is not necessary for the simultaneous addition to mix for an additional period. Thus, treatment of the starting crude includes both contacting and agitation to form an emulsion, for example, mixing. Heavier crudes, such as those with API indices of 20 or lower and viscosities greater than 200 cP at 25° C., preferably, will be treated at temperatures above 60° C.

Once the water in oil emulsion has been formed, it is separated, preferably, it is subjected to sonication and then separated into a plurality of layers. The separation can be achieved by means known to those skilled in the art. For example, centrifugation, gravity settling, sonication, hydrocyclones, microwave, electrostatic separation and combinations thereof.

It may be necessary to sonicate the emulsion prior to separating into oil and water layers. This will be readily evident to the skilled artisan since the other commonly utilized techniques for separation noted above will fail to separate the emulsion. Thus, sonication may be necessary to break the emulsion prior to separation into layers. Sonication will be conducted at temperatures ranging from about 20 to about 250° C. at ambient pressures up to about 200 psig (1480 kPa). Continued sonication or an alternative separation means can then be employed to effect the separation. A plurality of layers result from the separation. Typically, at least three layers will be produced. The uppermost layer contains the starting oil from which the acids have been removed. The solids having adsorbed thereon high and medium weight acids will form the intermediate layer, while the bottom layer is an aqueous layer containing the added water and other components contained in the crude that may have dissolved in the water. The uppermost layer containing treated oil is easily recoverable by the skilled artisan. Thus, unlike the treatments used in the past whereby the acids are converted into products which remain in the oil, the instant process removes the acids from the oil.

Additionally, though not required, demulsification agents may be used to enhance the rate of demulsification and co-solvents, such as alcohols, may be used along with the water.

Use of demulsifiers in the invention is optional. If such demulsifiers are utilized, the demulsifiers will be selected from any known demulsifiers and when a sonication step is used for separation the demulsifier choice is restricted to those that will not degrade during sonication. Such demulsifiers can be readily selected. Typically, the demulsifiers utilized when sonication is employed will have a molecular weight of about 500 to about 5000, preferably about 500 to about 2000 and a hydrophilic lipophilic balance of above 9, preferably about 9 to about 30 and most preferably about 9 to about 15. Demulsifiers which will not degrade during sonication will not contain functional groups such as esters or amides. Useable demulsifiers will include, but are not limited to those which contain functional groups such as ethers, amines, ethoxylated alcohols, sulfonates and mixtures thereof. A particularly preferred demulsifier is a phenolformaldehyde ethoxylated propoxylated resin. When no sonication is applied, any demulsifier known to the skilled artisan can be employed to demulsify the emulsion.

The demulsifier will be added to the emulsion after solids addition and prior to the separation step. The amount of demulsifier to be added will range from about 0.1 to about 5.0 wt % based on the amount of the emulsion. Additionally, a delivery solvent may be employed. Such solvents may include crude oil distillates boiling in the range of about 70° C. to about 450° C., alcohols, ethers and mixtures thereof. Thus, the delivery solvents may be selected from the group consisting of the above.

The delivery solvent will be present in an amount of from about 35 to about 75 wt % in the demulsifier. Thus, when utilized, the delivery solvent will be included in the 0.1 to 5.0 wt % demulsifier added to the emulsion.

A particulary preferred demulsifier is a phenolformaldehyde ethoxylated alcohol having the structure:

wherein R is selected form the group consisting of alkanes or alkenes from 8 to 20 carbons, E is $CH_2$—$CH_2$ and P is —$CH_2$—CH—$CH_3$, n ranges from 1 to 5, m

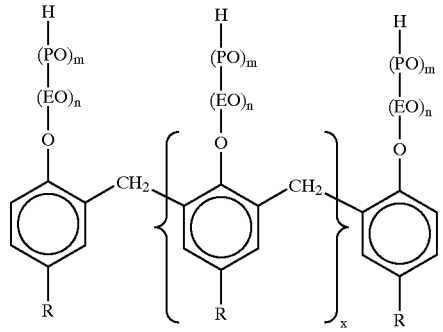

ranges from 0 to 5 and x ranges from 3 to 9.

In the instant invention, it may be necessary to apply sonic energy to break the interfacial film present in the water-in-oil emulsion formed.

If sonication is required, it is typically accomplished at energies of about 25 to about 500 watts/cm$^2$. The velocity of sound in liquids is typically about 1500 meters/sec. Ultrasound spans the frequency of about 15 kHz to 10 MHz with associated wavelengths of about 10 to 0.02 cm. The invention may be practiced at frequencies of about 15 kHz to about 20 MHz. The output energy at a given frequency is expressed as sonication energy in units of watts/cm2. The sonication provided for in the instant invention is typically accomplished at energies of about 25 to about 500 watts/cm$^2$.

Following the sonication, the sonicated emulsion is separated by methods such as centrifugation, hydrocyclones, microwave, sonication, gravity settling, electrostatic field, combinations thereof, or by any other methods known to the skilled artisan for phase separation. The oil may then be recovered as a separate phase.

To determine the amount of sonic energy necessary to break the interfacial film of the emulsion, a series of samples of the water-in-oil emulsion are treated by applying sonic energy. At least three samples will form the series. Typically, at least 3 to 20 samples, and more preferably at least 3 to 10 samples, and more preferably 3 to 5 samples will be utilized. The sonic energy is applied to each sample, with each proceeding sample being sonicated at an energy at least about 25 to about 50 watts/cm$^2$ higher than the preceeding sample. Once sonication is complete, the samples are separated into a water phase and an oil phase or layer and the percent water demulsified or separated out is measured. A maximum amount of water demulsified can then be identified and the energy of sonication corresponding to the amount applied to produce the highest quantity of water demulsified is equivalent to the strength of the interfacial film of the emulsion. The amount of energy to be applied to the first of the series of samples is about 25 to about 50 watts/cm$^2$.

One skilled in the art will readily recognize that the sonic energy to be applied to break the interfacial film of the emulsion, if necessary, can be lowered by use of a demulsifier.

The process can be conducted utilizing existing desalter units. The process is applicable to both production and refining operations. In the refinery, the acidic oil stream is treated with the required amount of solids by adding the solids to the crude oil and mixing with a static mixer at low shear. Alternatively, the solids can be added first, mixed and followed by water addition and mixing. The treated starting oil which is a crude oil, crude oil blend or crude distillate is then subjected to sonication, if necessary, followed by demulsification or separation in a desalting unit which applies an electrostatic field or other separation means. The oil with reduced TAN is drawn off at the top and subjected to further refining if desired. The middle and lower aqueous phases are drawn off and discarded. The middle layer containing the solids and extracted naphthenic acids can be treated by methods known to those in the art, to produce a non-corrosive product, or discarded as well.

The following examples are meant to be illlustrative and not limiting in any way.

EXAMPLES 1–7

The general procedure to prepare a water-in-crude oil emulsion involved adding solids (0.15 wt % based on weight of oil) to the oil followed by addition of water or brine and mixing. A Silverson mixer supplied by Silverson Machines, Inc. East Longmeadow, Mass. was used. Mixing was conducted at 25° C. and at 400 to 600 rpm for a time required to disperse all the water into the oil. Water was added to the crude oil in aliquots spread over 5 additions. When demulsifier was used it was added to the emulsion at a treat rate of 0.4 to 0.5 wt % demulsifier formulation based on the weight of emulsion and mixed with a Silverson mixer at 400 to 600 rpm for 10 to 15 minutes. A phenol formaldehyde ethoxylated alcohol demulsifier formulation sold by BASF Corporation as Pluradyne DB7946 was used.

Centrifugation was conducted at 25° C. using a Beckman L8-80 Ultracentrifuge at 10,000 rpm (7780 g) for 30 minutes to effect separation of the water and oil phases. Sonication was conducted using a Sonifier Model 350. The pulse mode operating at an output control setting of 4 was used and sonication conducted for 2 minutes. At the control setting of 4 the output energy is about 150 Watts/cm$^2$. The frequency of the sonic waves was 20 kHz. Electrostatic demulsification was conducted using a model EDPT-128™ electrostatic dehydrator and precipitation tester available from INTER-AV, Inc., San Antonio, Tex. Demulsification was conducted at an 830 volt/inch potential for 30 to 180 minutes at temperatures of 60 and 85° C.

Two crude oils, Kome and Tulare from West Africa and USA respectively were used. Hydrophobic silica sold under the trade name Aerosil R 972 by DeGussa Corporation and hydrophobic bentonite clay (prepared in the laboratory by exposing divided/delaminated clay to crude oil and air oxidation) were used as the silica and clay solids.

In a typical experiment 30 to 40 grams of emulsion were weighed into graduated centrifuge tubes or electrostatic cells tubes and treated as indicted in Table-1. After separation three layers were observed. The naphthenic acaid content of the upper oil layer was determined by Fourier Transform Infra Red (FTIR) method known to one skilled in the art of crude oil analyses.

Results in Table-1 compare performance of solids addition to no solids addition and to demulsifier addition are provided.

EXAMPLE 8

A 40/30/30: Isopar-M/Solvent 600 N/Aromatic 150 was used as a model oil (Oil M), with 5-beta cholanic acid as a model naphthenic acid. A 1% solution of acid was made with the Model M oil. To 7 g of this oil was added 3 g of water and an water-in-oil emulsion prepared. To the emulsion was added 0.15 wt % divided bentonite gel and mixed. The mixture was then centrifuged to separate the oil and water phases with the apprearance of an intermediate layer. Infra red analyses was conducted on the upper oil layer.

TABLE 1

| Example | Crude Oil | Water | Solids Added | Oil/Water Ratio | Demulsifier | Sonication 150 Watts/cm^2 | Separation Means | % Nap Acid Reduction |
|---|---|---|---|---|---|---|---|---|
| 1 | Kome | Kome Brine | None | 40/60 | None | None | Centrifugation | 0 |
| 2 | Kome | Kome Brine | Clay | 40/60 | None | 2 minutes | Centrifugation | 86 |
| 3 | Kome | Kome Brine | None | 80/20 | 0.5 wt % | None | Electrostatic | 32 |
| 4 | Kome | Kome Brine | None | 80/20 | 0.5 wt % | 2 minutes | Electrostatic | 35 |
| 5 | Kome | Kome Brine | Clay | 80/20 | 0.5 wt % | 2 minutes | Electrostatic | 86 |
| 6 | Tulare | Tulare Brine | None | 70/30 | None | None | Centrifugation | 0 |
| 7 | Tulare | Tulare Brine | Silica | 70/30 | None | 2 minutes | Centrifugation | 47 |
| 8 | Oil M | water | Clay | 70/30 | None | None | Centrifugation | 85 |

What is claimed is:

1. A process for extracting organic acids from a starting oil comprising the steps of:

(a) treating the starting oil containing organic acids with an amount of solids and water under conditions and for a time and at a temperature sufficient to form a water-in-oil emulsion of said starting oil, water and solids wherein said solids are selected from solids having a total average surface area of less than or equal to 1500 square microns;

(b) separating said emulsion of step (a) into a plurality of layers wherein one of such layers contains a treated oil having decreased amounts of organic acids;

(c) recovering said layer of step (b) containing said treated oil having a decreased amount of organic acid and layers containing water and solids wherein said solids are selected from silica, alumina, coke, montmorillonite clays, and mixtures thereof.

2. The process of claim 1 wherein said water is added simultaneously with or following said solids.

3. The process of claim 1 wherein the amount of water added is about 5 to about 10% based upon the weight of the starting crude oil.

4. The process of claim 1 wherein said amount of solids is about 0.1 to 5 wt % based on the weight of oil.

5. The process of claim 1 wherein said steps (a) and (b) are conducted at temperatures of about 20 to about 220° C.

6. The process of claim 1 wherein said steps (a) and (b) are conducted for times of about one minute to about one hour.

7. The process of claim 5 wherein when said starting oil is a crude oil and said crude oil has an API index of about 20 or lower, said temperature is above about 60° C.

8. The process of claim 1 wherein said separation step (b) is achieved using gravity settling, electrostatic field separation, centrifugation or a combination thereof.

9. The process of claim 1 wherein co-solvents are added with said water.

10. The process of claim 1 wherein demulsifiers are added to said separation step.

11. The process of claim 9 wherein said co-solvent is an alcohol.

12. The process of claim 10 wherein said demulsifier is selected from a demulsifier having a molecular weight of about 500 to about 5000 and which contains functional groups selected from the group consisting of ethers, amines, ethoxylated alcohols, sulfonates, and mixtures thereof.

13. The process of claim 10 wherein said demulsifier is added in an amount of about 0.1 to about 5.0 wt %.

14. The process of claim 13 wherein about 35 to about 75 wt % of a delivery solvent is added to said demulsifier.

15. The process of claim 1 wherein said process is conducted in a refinery and said separation is conducted in a desalting unit to produce a phase containing a treated crude having organic acids removed therefrom, and phase containing water.

16. The process of claim 1 wherein said montmorillonite clay solid is a bentonite clay.

17. The process of claim 16 wherein said bentonite clay is a gel.

18. The process of claim 12 wherein said demulsifier is an ethoxylated alcohol having the formula:

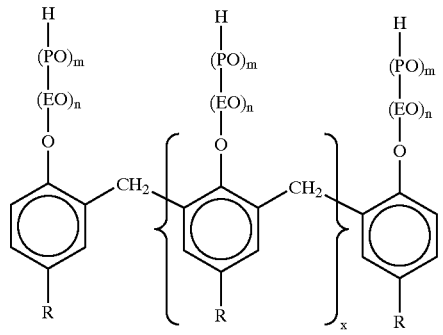

wherein R is selected form the group consisting of alkanes or alkenes from 8 to 20 carbons, E is $CH_2$—$CH_2$ and P is —$CH_2$—CH—$CH_3$, n ranges from 1 to 5, m ranges from 0 to 5 and x ranges from 3 to 9.

19. The process of claim 1 wherein said emulsion is sonicated at about 25 to about 500 watts/$cm^2$ prior to said separation step (b).

20. The process of claim 1 wherein said starting oil is a crude oil, crude oil distillate, crude oil blend or mixtures thereof.

21. The process of claim 19 wherein said sonication is conducted at frequencies of about 15 kHz to about 10 MHz.

* * * * *